US011547918B2

(12) United States Patent
Matsushima

(10) Patent No.: US 11,547,918 B2
(45) Date of Patent: Jan. 10, 2023

(54) BACKPACK CARRIER TYPE GOLF PRACTICE TOOL

(71) Applicant: Koho Co., Tokyo (JP)

(72) Inventor: Shigeharu Matsushima, Tokyo (JP)

(73) Assignee: KOHO CO.

( * ) Notice: Subject to any disclaimer, the term of this patent is extended or adjusted under 35 U.S.C. 154(b) by 0 days.

(21) Appl. No.: 17/500,047

(22) Filed: Oct. 13, 2021

(65) Prior Publication Data

US 2022/0118336 A1 Apr. 21, 2022

Related U.S. Application Data

(60) Provisional application No. 63/093,922, filed on Oct. 20, 2020.

(51) Int. Cl.
*A63B 69/36* (2006.01)
*A63B 69/00* (2006.01)

(52) U.S. Cl.
CPC ..... *A63B 69/36* (2013.01); *A63B 69/0059* (2013.01)

(58) Field of Classification Search
CPC . A63B 69/36; A63B 69/0059; A63B 2225/62; A63B 69/3608; A63B 69/3621
USPC ..... 473/257
See application file for complete search history.

(56) References Cited

U.S. PATENT DOCUMENTS 2,943,859 A * 7/1960 Koski ..... A41D 13/08 128/892
3,019,952 A * 2/1962 Brewster ..... A45C 3/00 294/142
3,960,300 A * 6/1976 Dickler ..... A45F 3/04 D3/217
3,995,802 A * 12/1976 Johnston ..... A45F 3/04 294/157
D307,811 S * 5/1990 Branco ..... D3/289
D355,297 S * 2/1995 Ash, Jr. ..... D3/217
5,704,846 A * 1/1998 Johnson ..... A63B 69/0059 473/270
D406,942 S * 3/1999 Santoro ..... D3/216
5,967,390 A * 10/1999 Goryl ..... A45F 3/02 383/3

(Continued)

FOREIGN PATENT DOCUMENTS

JP 2012-200484 A 10/2012

*Primary Examiner* — Nini F Legesse
(74) *Attorney, Agent, or Firm* — Harness, Dickey & Pierce, P.L.C.

(57) ABSTRACT

A golf practice tool is provided having a columnar box. The columnar box is provided with a shoulder belt and the columnar box is carried on the back of the golf player. The columnar box has a substantially flat upper surface. A plurality of striped line patterns or striped patterns substantially parallel to a side surface, which touches a back of a person and is called a back touch side surface, of the columnar box are drawn on the upper surface. The degree of inclination of the upper body of the golf player when playing golf can be adjusted by using the striped line patterns or the striped patterns. On side surfaces other than the back touch side surface of the columnar box, a plurality of vertical striped line patterns or vertical striped patterns are drawn substantially at right angles to the bottom surface of the columnar box. The degree of rotation of the upper body at a golf swing can be adjusted by using the vertical striped line patterns or the vertical striped patterns.

18 Claims, 9 Drawing Sheets

(56) References Cited

U.S. PATENT DOCUMENTS

| | | | | |
|---|---|---|---|---|
| D471,712 | S * | 3/2003 | Krulik | D3/289 |
| 8,156,974 | B2 * | 4/2012 | Pace | A45C 3/08 383/111 |
| D771,373 | S * | 11/2016 | Kim | D3/217 |
| 10,051,935 | B1 * | 8/2018 | Davison | A45C 3/08 |
| 10,080,420 | B2 * | 9/2018 | Alexis | A45F 3/04 |
| D875,385 | S * | 2/2020 | Carter | D3/217 |
| D939,824 | S * | 1/2022 | Shabi | D3/217 |
| 2005/0133399 | A1 * | 6/2005 | Fidrych | A45F 3/04 206/545 |
| 2014/0103081 | A1 * | 4/2014 | Alsaffar | A45F 3/04 224/154 |

* cited by examiner

BACKPACK CARRIER TYPE GOLF PRACTICE TOOL

CROSS-REFERENCE TO RELATED APPLICATIONS

This application claims priority to U.S. Provisional Patent Application No. 63/093,922, filed Oct. 20, 2020, the disclosure of which is hereby expressly incorporated by reference herein in its entirety.

BACKGROUND

Technical Field

The present invention relates to a golf practice tool that determines a posture of a golf player at the time of addressing.

Related Art

Though golf looks like a simple sport because a golf player hits a golf ball at rest, the golf player needs to hit the ball with the best posture of the body to fly the ball in the desired direction and distance. Since beginners do not know what kind of posture to hit the ball, they struggle to hit the ball because the direction of the ball is not stable. It is particularly difficult for the golf player to determine a forward tilt angle of the upper body when they hit the ball and a rotation angle of the upper body during backswing. The golf Player needs to swing properly a golf club to determine the direction of the ball and to improve a flying distance of the ball. In order to achieve such a proper swing, the position of the ball and the foot need to be optimized. Also, when the golf player hit the ball with the golf club, the golf player needs to make properly the droopy posture of the upper body and the rotational posture of the upper body.

Japanese Unexamined Patent Application Publication No. 2012-200484 discloses a golf practice tool composed of a main pillar, a straight rod, and a tripod. This golf practice tool is placed in front of a golf player. The player practices golf swings by changing the position of the straight rod and defining their posture. The beginners are difficult to correct their posture because specialized knowledge is required to determine the position of the straight rod when they change the position. Since the tool is large and it is troublesome to carry around, it is difficult for them to practice while moving it.

SUMMARY

We provide a golf practice tool with which even beginners can easily improve their golf skills. The present invention has the following features.

(1) The present invention is a golf practice tool having or comprising a columnar box, wherein the columnar box is provided with shoulder straps and the columnar box is carried on the back of a golf player. The columnar box has a substantially flat upper surface. A plurality of striped line patterns or striped patterns substantially parallel to a side surface, which touches the back of a golf player and is called a back touch side surface, of the columnar box are drawn on the upper surface of the columnar box. The degree of inclination of the upper body of the golf player when playing golf can be adjusted by using the striped line patterns or the striped patterns.

(2) In the present invention, in addition to (1), the shape of the columnar box is a partial circular cylinder having substantially circular cylindrical side surface except for a side surface (referred to as a back touch side surface) that touches on the back of the golf player. Alternatively, the shape of the columnar box is a trapezoidal column (pillar) having a substantially trapezoidal bottom surface. The side surface of the trapezoidal column corresponding to the long base of the trapezoidal shape is the surface that touches the back (referred to as a back touch side surface). Alternatively, the shape of the columnar box is a polygonal column (pillar) having a substantially polygonal bottom surface, and one of the side surfaces of the polygonal column is a surface that touches the back (referred to as a back touch side surface).

(3) In the present invention, in addition to (1) or (2), on side surfaces other than the back touch side surface of the columnar box, a plurality of vertical striped line patterns or vertical striped patterns are drawn substantially at right angle to the bottom surface of the columnar box. The degree of rotation of the upper body at a golf swing can be adjusted by using the vertical striped line patterns or the vertical striped patterns.

(4) In the present invention, in addition to (1) or (2) or (3), the main material of the columnar box is a plastic, and the plastic is a foamed plastic, or the main material of the columnar box is a urethane foam or a styrofoam. Alternatively, the columnar box is a balloon body formed by inflating with gas. Also, A flexible member is arranged on the back touch side surface, and the flexible member is an air mat.

(5) The present invention is an arm supporter type golf practice tool having an arm ring to be worn on the arm. Vertical striped line patterns or vertical striped patterns are arranged substantially parallel to the longitudinal direction of the arm supporter. The state of the arm at a golf swing can be adjusted by using the vertical striped line patterns or the vertical striped patterns.

Advantageous Effect of the Invention

Since backpack carrier type golf practice tool of the present invention is a tool for a golf plyer to practice golf by being carried on the back, the burden on the golf player is small. Also, since it is lightweight, it is easy to carry, the golf players can practice golf by shooting a round of golf while carrying the backpack carrier type golf practice tool of the present invention on their back. Since they can memorize how to hit a golf ball visually, they can easily understand how to hit a golf ball. Accordingly, even beginners can easily learn the posture of golf play. Especially, elementary school children can easily learn the basic posture of golf players while being interested.

DETAILED DESCRIPTION

Figure 1:
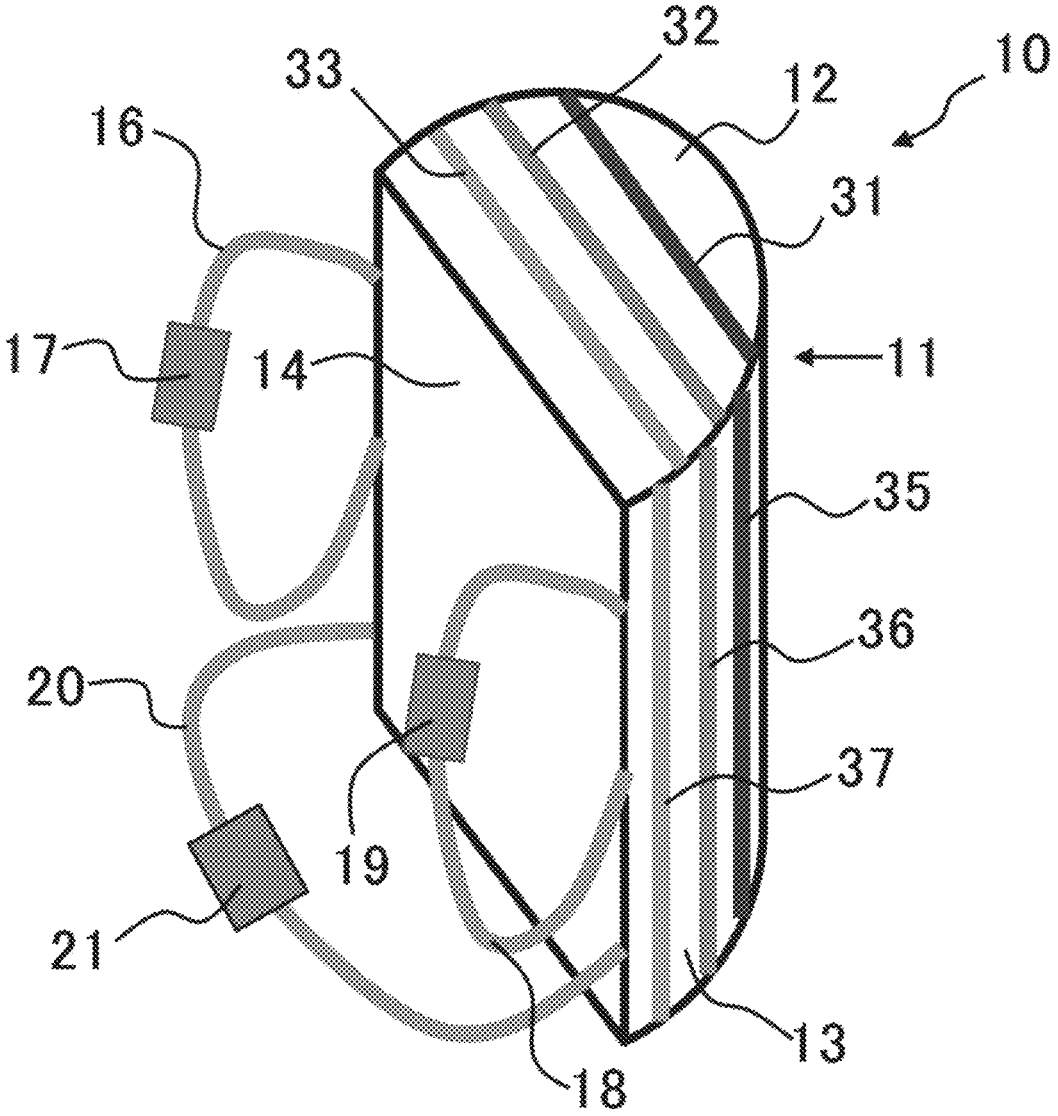
FIG. 1 shows the backpack carrier type golf practice tool of the present invention.
Figure 3:
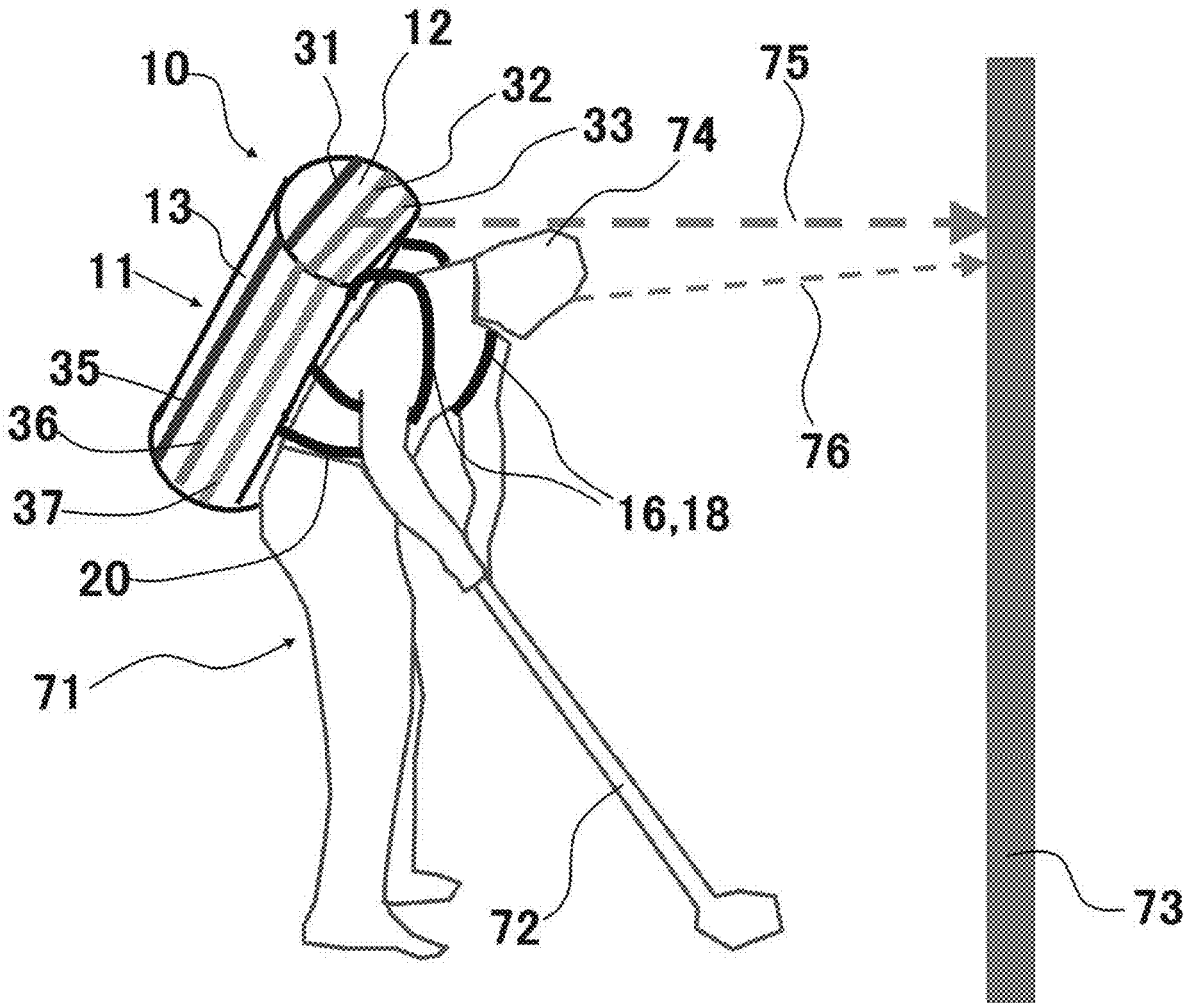
FIG. 3 is a diagram illustrating a method how to use the backpack carrier type golf practice tool of the present invention.
Figure 4:
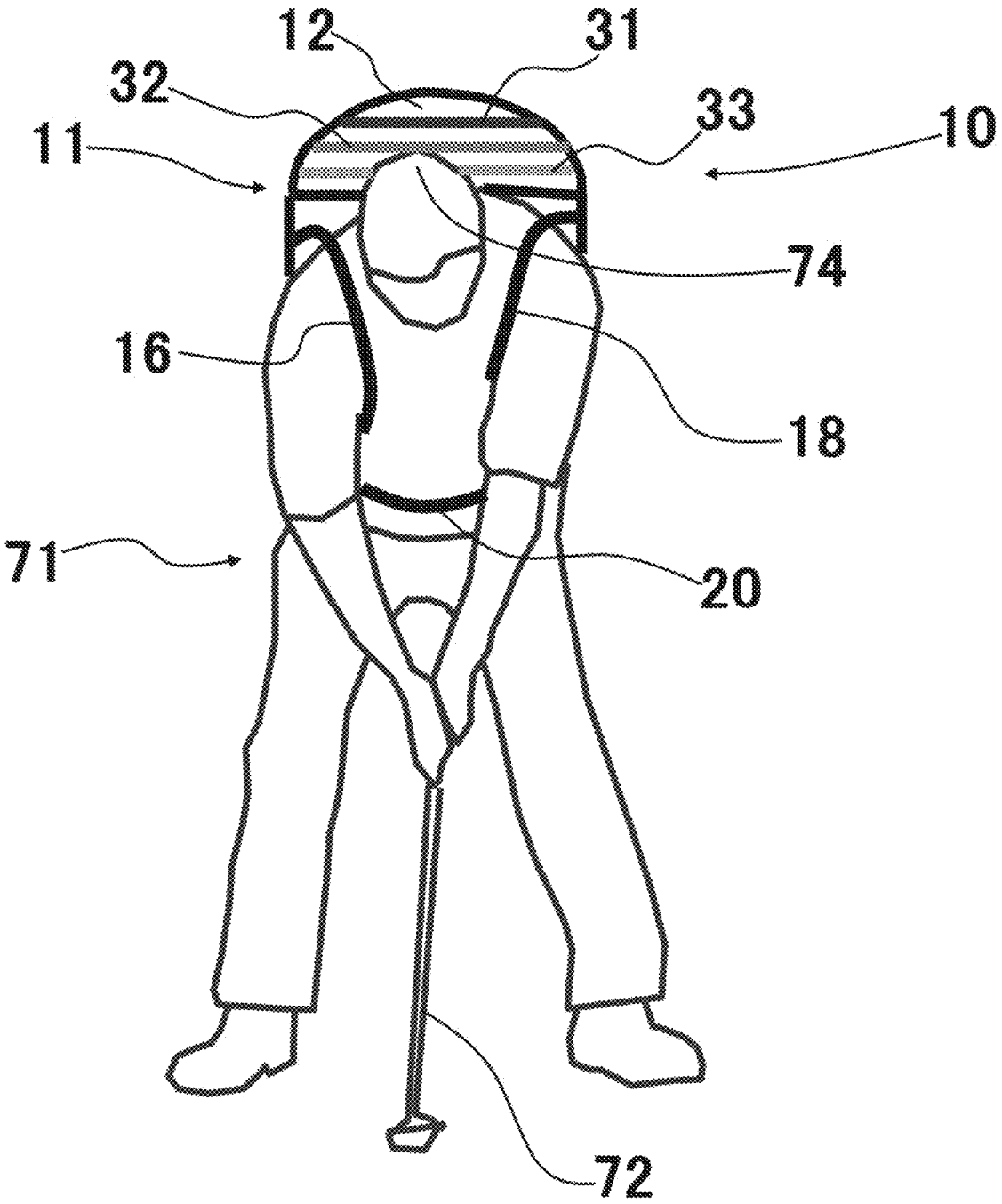
FIG. 4 is a view showing a state in which a golf player 71 is carrying the backpack carrier type golf practice tool 10.
Figure 5:
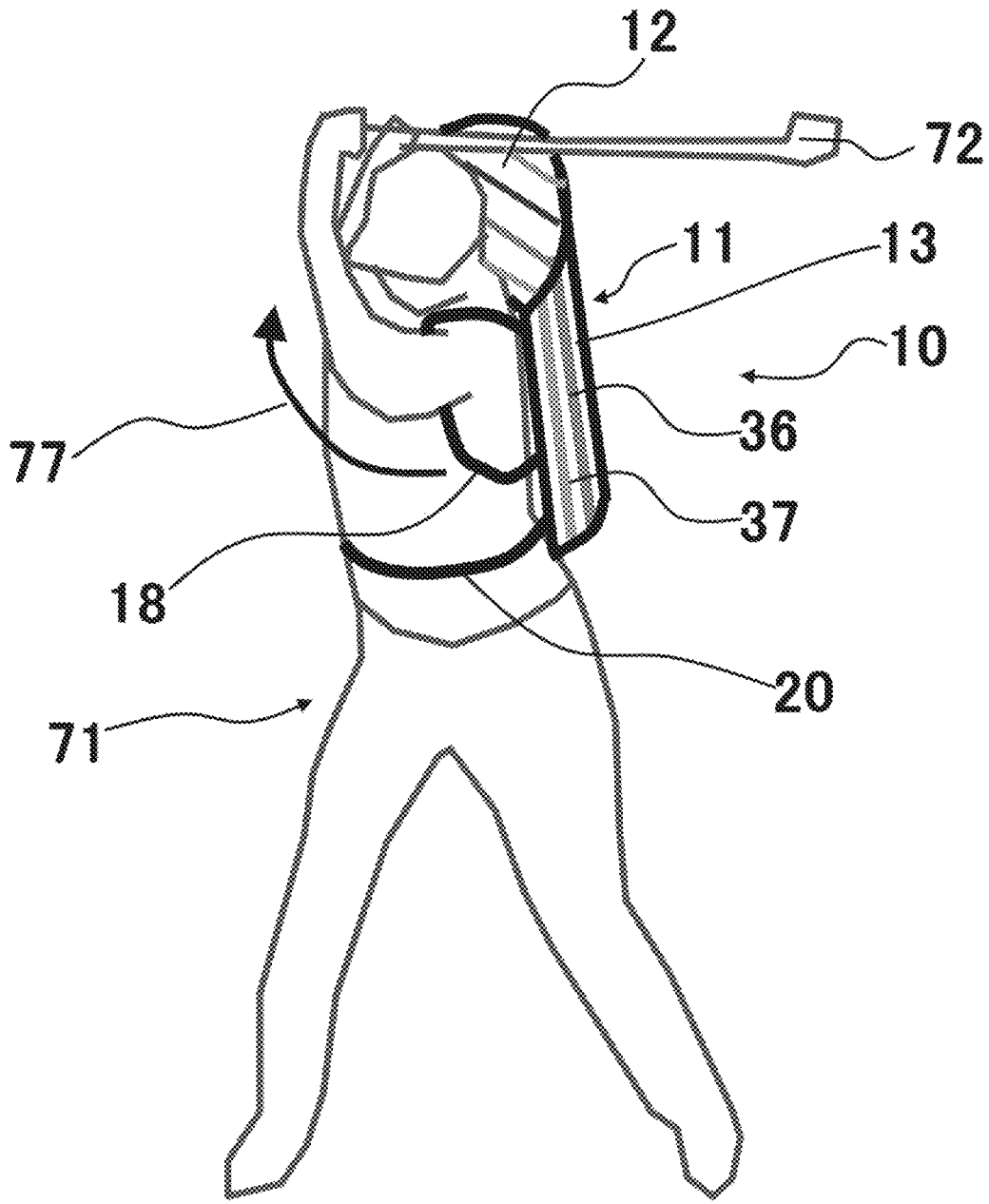
FIG. 5 is a diagram showing a top state of a backswing of the golf player wearing the backpack carrier type golf practice tool of the present invention on the back.

The backpack carrier type golf practice tool, which is also written the golf practice equipment, 10 of the present invention is shown in FIG. 1. A golf player practices golf by carrying it on the back of the player in the same way as a school bookbag or a rucksack, as shown in FIGS. 3 to 5. Accordingly, it may be called a school bookbag type golf practice tool or a rucksack type golf practice tool. The backpack carrier type golf practice tool, which may be simply written a golf practice tool or a golf practice equipment, 10 of the present invention comprises a columnar main body 11 of the backpack carrier type golf practice tool 10, and a shoulder strap 16, 18 to fix the main body 10 on the back and to hang it on the left and right shoulders of the golf player.

The main body 11 of the backpack carrier type golf practice tool 10 has a columnar shape. The part that touches the back is the side surface of the columnar main body 11, which is substantially a rectangular plane. That is, the main body 11 has a shape in which a part of a circular column (cylinder) is cut in the direction perpendicular to the bottom surface. The main body 11 shown in FIG. 1 has a columnar shape, which may be called a partial circular cylindrical shape or a cut circular cylindrical shape, as if a circular cylinder having a circular bottom surface was cut in a direction perpendicular to the circular surface of the bottom surface. Here, the cross section of the main body 11 is called a partial circle because a part of the circle is missing. The partial circle may be a semicircle, a partial circle wider than the semicircle, or a partial circle narrower than the semicircle. The portion of the main body 11 to touch the back may be in an uneven state so as to easily touch the back.

A cross-sectional shape or a bottom face or a top face of the main body 11 maybe an elliptical shape, a triangular shape, a quadrate or rectangular or square shape, a polygonal shape, or an arbitrary curved shape, or a shape similar to these in addition to the circular shape shown in FIG. 1. In the case of a polygonal shape such as a triangle, a back touch portion 14 that touches the back may be one of the side surfaces. That is, a back touch portion 14 may be not the cut surface.

The back touch portion 14 that touches the back may have an uneven portion though it has a planar shape in FIG. 1. Since it becomes difficult for the touch portion 14 to move on the back because the uneven portion is formed on the back touch portion 14, the main body 11 of the backpack carrier type golf practice tool (equipment) is stable on the back of the golf player. Alternatively, the back touch portion 14 may be formed in a shape that fits the shape of the back. In this case as well, since the back touch portion 14 is difficult to move on the back, the main body 11 of the backpack carrier type golf practice tool is stable on the back of the golf player. Alternatively, if a flexible member is attached to the back touch portion 14 or the touch portion 14 itself is a flexible member, since the back touch portion 14 fit the back by deforming according to the shape of the back and becomes difficult to move on the back, the main body 11 of the backpack carrier type golf practice tool (equipment) is stable on the back of the golf player. Since the flexible member touches the back, the golf players do not feel uncomfortable and have less fatigue even after long hours of practice. The flexible member is, for example, a flexible plastic, various rubbers, or various sponges, and the flexible plastic is, for example, urethane resin or polyvinyl chloride (PVC). Further, an air mattress or air pad containing a gas such as air may be used.

Both ends of the shoulder straps 16, 18 are fixed to the back touch portion 14 or the outer side surface 13 of the main body 11 of the backpack carrier type golf practice tool. The shoulder strap 16 is hung on the right shoulder, the shoulder strap 18 is hung on the left shoulder, and a length of the shoulder straps 16, 18 is respectively adjusted by using the length adjusting portions 17, 19 so that the main body 11 of the backpack carrier type golf practice tool is hung on the predefined position of the back and do not move on the back. Also, the waist-belt 20 may be attached to the main body 11 of the backpack carrier type golf practice tool to further prevent the main body 11 of the backpack carrier type golf practice tool from moving. Hieroglyphic 21 is a length adjusting portion for adjusting the length of the waist-belt 20. Both ends of the waist-belt 20 are fixed to the back touch portion 14 of the main body 11 of the backpack carrier type golf practice tool or the outer side surface 13 of the main body 11 of the backpack carrier type golf practice tool.

Striped line patterns or striped patterns 31, 32, and 33 are formed on the upper surface or the bottom surface 12 of the main body 11 of the backpack carrier type golf practice tool of the present invention. The striped patterns 31 to 33 define the inclination angle of the upper body of the golf player as shown later. The striped patterns 31 to 33 are preferably drawn substantially parallel to the back touch portion 14 in order to help the definition of the inclination angle. Since the striped patterns 31 to 33 are easier to describe when they are straight, the production cost to fabricate the backpack carrier type golf practice tool 10 can be reduced. Of course, they can also be drawn in a curved shape. If they are linear, they may be called striped line patterns. The number of striped patterns 31 to 33 may be larger. Since it will be difficult to specify the tilt angle if the number is too large, the number of the stripped patterns may be adjusted according to the learning level of the golf player. The striped patterns can be made easier to see by changing the color and brightness. Also, the striped patterns 31 to 33 may be color-coded by color, or the striped patterns may be color-coded by design.

Striped patterns 35, 36, and 37 are formed on a side surface 13 of the main body 11 of the backpack carrier type golf practice tool of the present invention, as shown in FIG. 1. Though a back side of the side surface 13 of the backpack type golf practice tool main body 11 is not visible since FIG. 1 is a perspective view, the similar or same striped patterns are also formed on the side surface of the back side of the side surface 13. Striped patterns 35 to 37 define the rotation angle of the upper body of the golf player as shown later. The striped patterns 35 to 37 are preferably drawn substantially perpendicularly to the upper surface or bottom surface 12 to make the rotation angle easier to define. Since the striped patterns 35 to 37 are easier to draw when they are straight, a production cost to fabricate the backpack carrier type golf practice tool 10 can be reduced. Of course, they can also be drawn in a curved shape. The number of striped patterns 35 to 37 may be larger. Since it will be difficult to specify the tilt angle if the number is too large, the number of the stripped patterns may be adjusted according to the learning level of the golf player. The striped patterns can be made easier to see by changing the color and brightness. Also, the striped patterns 35 to 37 may be color-coded by color, or the striped patterns may be color-coded by design.

Figure 2A:
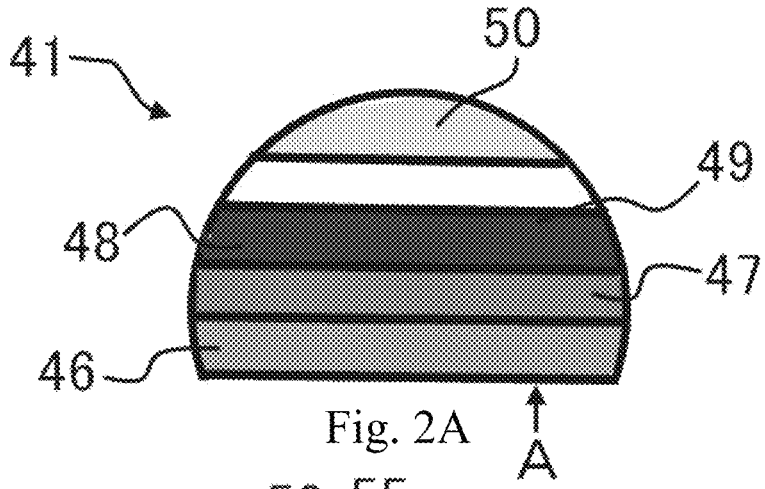
FIGS. 2A-2C show a plan view, an elevation view, and a side view, of the main body 11 of the backpack carrier type golf practice tool.
Figure 2B:
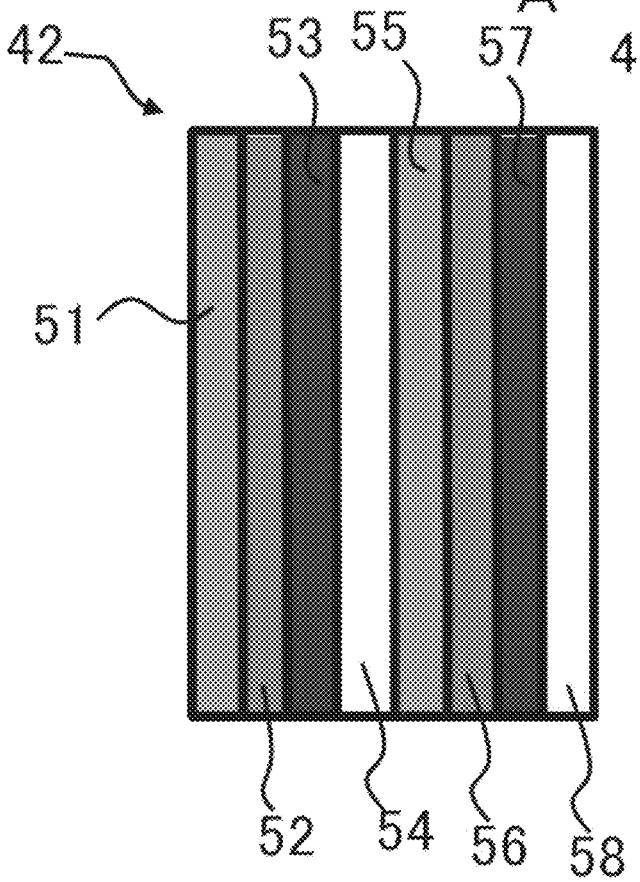
Figure 2C:
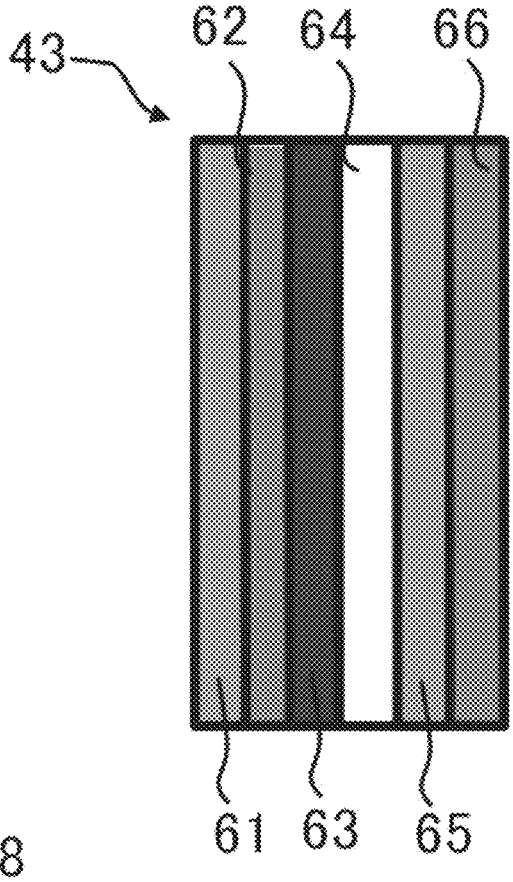

FIGS. 2A-2C show a plan view, an elevation view, and a side view, of the main body 11 of the backpack carrier type golf practice tool shown in FIG. 1. FIG. 2A is a plan view, that is, a top or bottom view. FIG. 2B is an elevation view or a front view seen from the direction opposite to the direction of an arrow A shown in the plan view of FIG. 2A, which is the direction opposite to the back touch surface and the upward direction in the plan view of FIG. 2A. FIG. 2C is a side view. The view seen from the A direction is the back touch portion 14 of the main body 11 of the backpack carrier type golf practice tool, but it is not necessary to have the patterns in the back touch portion 14 since the back touch portion 14 is not used for practice. The patterns of FIGS. 2A-2C are depicted as substantially rectangular color patterns. Even such color patterns can be used for practice to regulate the posture of a golf player. FIG. 2A shows an upper surface 41 of the main body 11 of the backpack carrier type golf practice tool, and approximately rectangular color patterns 46, 47, 48, 49, 50 are drawn. As shown later, it is possible to practice golf to determine the degree of inclination of the upper body of the golf player by using the color patterns 46 to 50. The number of the color patterns 46 to 50 may be smaller or larger, and it can be adjusted according to the skill level of the golf player.

FIG. 2B is an elevation view or front view seen from the direction opposite to the A direction and shows a side surface 42 of the main body 11 of the backpack carrier type golf practice tool. When the main body 11 of the backpack carrier type golf practice tool is carried on the back, substantially vertically long rectangular color patterns 51, 52, 53, 54, 55, 56, 57, 58 are drawn. FIG. 2C is a side view seen from a direction perpendicular to the A direction and shows a side surface of the main body 11 of the backpack carrier type golf practice tool. When the main body 11 of the backpack carrier type golf practice tool is carried on the back, substantially vertically long rectangular color patterns 61, 62, 63, 64, 65, 66 are drawn. Since the side surface of the main body 11 of the backpack carrier type golf practice tool is a curved surface, even if the widths of the rectangular color patterns 51 to 58 and 61 to 66 are the same, the widths change in the elevation view of FIG. 2B and the side view of FIG. 2C, but the change is not considered in these views. The larger the pattern change between the neighbors, the easier it is to see, so that it becomes easier to learn the degree of inclination and the degree of rotation. The number of color patterns can be also increased or decreased so as to match the skill level of the golf players. Although the upper surface and the side surface are filled with color patterns in FIGS. 2A-2C, the same can be also applied to the case of the striped patterns or the striped lines as shown in FIG. 1. Such striped patterns can also be made by, for example, sticking with colored tapes having various colors. If they are the color tapes, they can be replaced and changed according to the skill level of the golf player. Also, their colors may be changed according to the golf player's preference. Once the player's style is finalized, prominent color tapes can be also used to keep the style.

FIG. 3 is a diagram illustrating a method how to use the backpack carrier type golf practice tool of the present invention and shows a state in which the golf player carries the backpack carrier type golf practice tool on the back and practice hitting a golf ball. The golf players need to appropriately swing the golf club to hit a golf ball in an appropriate direction and to achieve a long distance of the golf ball. For those purpose, the golf player needs to set the forward leaning posture of the upper body with an appropriate angle of the forward leaning posture when the golf player hits the golf ball using the golf club. Though the appropriate angle of the forward leaning posture when swinging is said to be 30 to 35 degrees based on the past experiences and studies, it naturally changes depending on the physique, athletic ability, or skill level of the golf player. That is, the golf player needs to know the appropriate angle of the forward leaning posture that fits the conditions, for example, a physical constitution, athletic ability, or skill level. By using the backpack carrier type golf practice tool of the present invention, the golf players can easily set the angle of the forward leaning posture to the appropriate angle according to the conditions.

FIG. 3 is a side view showing the state of the body of the golf player when the golf player carries the backpack carrier type golf practice tool 10 of the present invention on the back and takes the forward leaning posture and impacts or hits the golf ball. The golf player practices while imagining the physical condition at the time of impacting or hitting the ball so as to be in such state while shaping the state at the time of impacting or hitting the ball in the mind. Since it is very difficult to imagine what kind of state the forward leaning posture is if there is no standard, it is difficult to get the posture that the golf player imagines at time of the actual golf swing. When the backpack carrier type golf practice tool 10 of the present invention is used, as shown in FIG. 3, the upper surface 12 of the main body 11 of the backpack carrier type golf practice tool 10 carried on the back is reflected in the mirror arranged in his front when the golf player takes the forward leaning posture.

Since the striped patterns 31 to 33 are drawn on the upper surface 12 of the main body of the backpack carrier type golf practice tool, the striped pattern, which is the striped line pattern 32 in this case, that appears over the head 74 of the golf player 71 travels as shown by the arrow 75 and is reflected in the mirror 73. The golf player 71 can confirm the striped line pattern 32 reflected in the mirror 73 arranged in front of the golf player 71 and can imagine the forward leaning posture. If it is better to reduce the forward leaning posture angle, the striped pattern 33 or the space between the striped patterns 32 and 33 may be reflected in the mirror 73. In this way, the golf player can easily visually know his own forward leaning posture angle, and he can memorize such state. If there is not a mirror, the golf player can ask someone else to see and teach the forward leaning posture angle.

FIG. 4 is a view showing a state in which a golf player 71 is carrying the backpack carrier type golf practice tool 10 shown in FIG. 3 on his back is seen from the front. That is, FIG. 4 shows a state in which the shoulder straps 18 and 19 are hung on the shoulders of the golf player 71, and the waist-belt 20 is also used to fix the main body 11 of the backpack carrier type golf practice tool to the back of the golf player 71, and the golf player 71 takes a forward leaning posture. As can be clearly seen from the front of the golf player 71, the upper surface 12 of the main body 11 of the backpack carrier type golf practice tool can be seen, and the striped line pattern or striped pattern 32 can be seen over the head 74 of the golf player 71. While imagining this forward leaning posture state, the state of the forward leaning posture can be obtained when the golf club is swung and the ball is impacted by the golf club. When the golf player swings the golf club and hits the ball in the imaged state, the golf player can know which direction the ball flies in and how much the flying distance of the ball is by taking the imaged degree of the forward leaning posture.

If the direction and the flight distance are insufficient, the forward leaning posture angle may be changed. For example, the space between the striped lines 32 and 31 may be seen over the head 74 in the mirror to decrease the forward leaning posture angle, or the striped line 31 may be seen over the head 74 in the mirror to decrease less the forward leaning posture angle. Also, the space between the striped lines 32 and 33 may be seen over the head 74 in the mirror to increase the forward leaning posture angle, or the striped line 33 may be seen over the head 74 in the mirror to increase more the forward leaning posture angle. In this way, by using the main body 11 of the backpack carrier type golf practice tool of the present invention, the golf player can visually imagine the forward leaning posture angle and set it at a constant angle, so that he can fly the golf ball in a desired direction and at a desired flying distance. In FIG. 3, it is important to prevent the main body 11 of the backpack carrier type golf practice tool from moving during a posture correction practice or a golf club swing practice by fixing the main body 11 on the back by hanging the shoulder straps 18 and 19 on the left and right shoulders and turning the waist-belt 20 round the waste.

Since golf players want to fly the ball as far as possible, the backswing posture and the speed at which the golf club is swung down are important. What is important in the posture at the backswing is to rotate the waist and the shoulder moderately. An extent of rotation of the waist and shoulders also determines the swing-down speed of the golf club to some extent. Though it is said that ideally the waist may rotate at a 45 degree angle and the shoulder may rotate at a 90 degree angle at the top of the backswing, it is important to know the optimum rotation degrees of the waist and the shoulder based on the physical ability and skill level of the golf player. FIG. 5 is a diagram showing a top state of a backswing of the golf player wearing the backpack carrier type golf practice tool of the present invention on the back. When the waist and shoulders of the golf player 71 are rotated as shown by the arrow 77 while keeping the axis of the body with suppressing the movement of the lower body of the golf player 71, the main body 11 of the backpack carrier type golf practice tool of the present invention carried on the back rotates and the vertical striped patterns drawn on the side surface 13 of the main body of the backpack carrier type golf practice tool becomes visible from the front of the golf player 71 as shown in FIG. 5. In FIG. 5, vertical striped line patterns 36 and 37 are seen. The golf player can know how much distance will be obtained when the golf club is swung down from such the state and the ball is impacted. If the golf player practices by grasping the degree of twist or rotation of the upper body with these striped patterns, the golf player can get a nearly constant flying distance. By using the backpack carrier type golf practice tool of the present invention in this way, it is possible to know how the striped patterns look with a mirror arranged in front when the body is twisted or rotated. Accordingly, the golf player can alone practice golf without a help of others. Also, even if the mirror is not used, the golf player can have someone else look and teach.

The lighter the main body of the backpack carrier type golf practice tool of the present invention, the more comfortable it can be carried on the back. For example, the material of the main body of the backpack carrier type golf practice tool is a fiber such as plastic or paper. Plastics include, for example, polyvinyl chloride (PVC) and polyurethane. Since polyvinyl chloride (PVC), polyurethane, and the like are flexible plastics, there is no problem that the body hurts even if the main body of the backpack carrier type golf practice tool directly touches the body. It is especially important that children do not feel a sense of discomfort to their body. Of course, various other flexible plastics can also be used. Foamed plastics make it very lighter, even children can easily carry it on their backs. Foamed plastics include, for example, urethane foam, styrofoam, and propylene foam. If the inside of the main body of the backpack carrier type golf practice tool is hollow, it will be considerably lighter, therefor the outer material or the outer layer material can be made of a metal such as iron, stainless steel, and various alloys. To make it lighter, it may be made of a metal such as titanium or its alloy, or aluminum or its alloy. Alternatively, it may be foldable and have a predetermined shape when opened. Its shape is, for example, partial circular columnar, partial elliptical columnar, rectangular columnar, trapezoidal columnar or polygonal columnar. Alternatively, various plastics may be produced by mixed, or various materials may be combined. Alternatively, the inside may be made of foamed plastic such as styrofoam and the surface may be made of another plastic material or cloth. For example, the surface of foamed plastic can be covered with polyvinyl chloride or cloth. In that case, a striped pattern can be printed on the surface material or on the surface covering material. In this case, if the surface material or the surface covering material becomes dirty, it can be replaced or washed. When the shape of the columnar box, which is the main body of the backpack carrier type golf practice tool, is a trapezoidal pillar (column) having a substantially trapezoidal bottom surface, the side surface of the trapezoidal pillar corresponding to the trapezoidal lower base, which is longer than the trapezoidal upper base, is the surface that touches the back, which is called the back touch side surface. When the shape of the columnar box is a polygonal column having a substantially polygonal bottom surface, one of the side surfaces of the polygonal column is the surface that touches on the back, which is called the back touch side surface.

If the main body of the backpack carrier type golf practice tool is a balloon, it may be deflated when it is not used, and it may be inflated with a gas such as air or nitrogen only when it is used, therefor since it does not take up space when it is stored, it can be stored anywhere. Since it is not heavy, it can be hung on a wall for storage. In the case of the balloon type or the balloon body, a frame body may be made so as to have a predetermined shape, which is, for example, partial circular columnar shape, partial elliptical columnar shape, rectangular columnar shape, trapezoidal columnar shape, or polygonal columnar shape, when it is inflated. It may be made so as to have a predetermined shape only when it is inflated. The outer material or the outer layer material of the balloon body is a rubber, a stretchable elastomer, a cloth or a paper. In the case of the balloon body, since it is very light, the golf player can practice in almost the same state as the actual play without the backpack carrier type golf practice tool.

Figure 9:
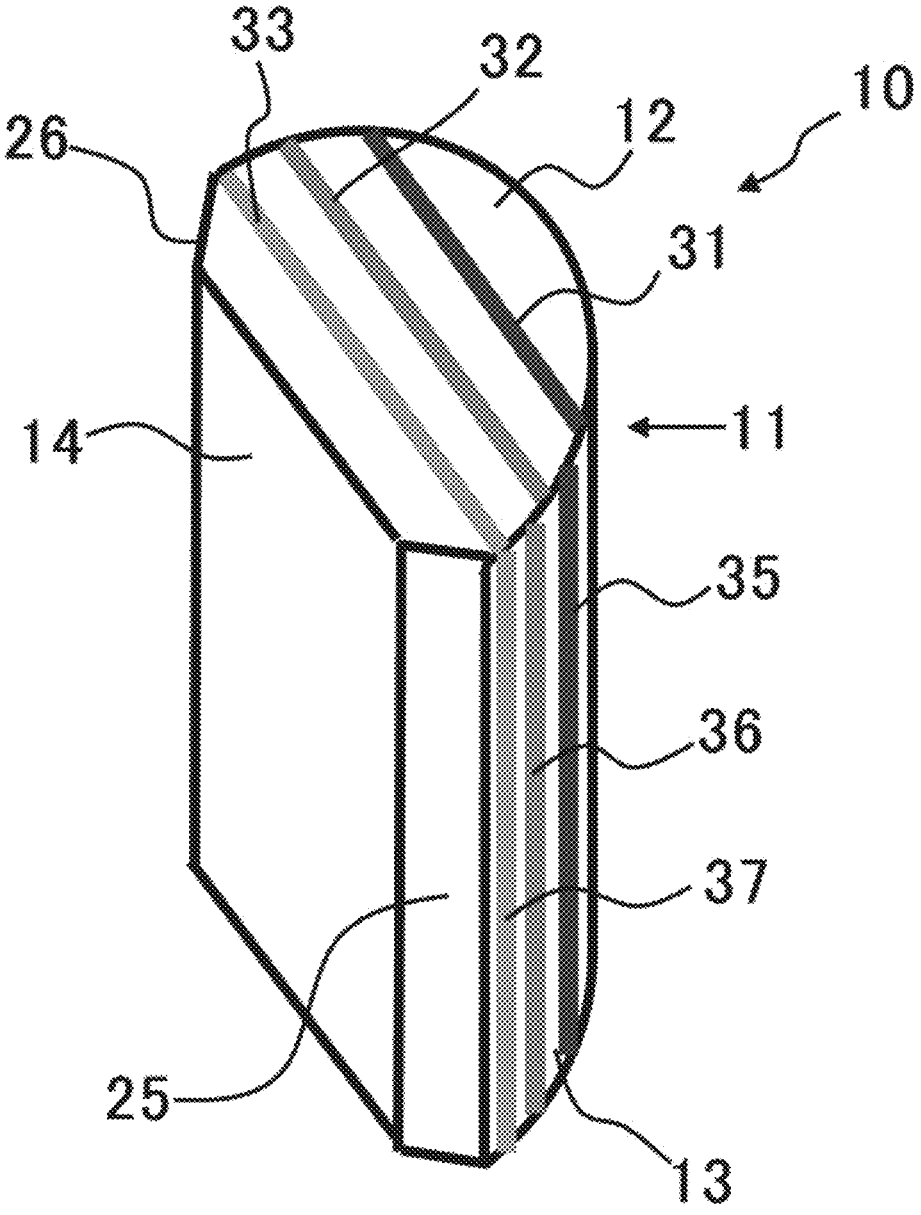
FIG. 9 is a diagram showing a modified embodiment of the partially circular columnar backpack carrier type golf practice tool shown in FIG. 1.

FIG. 9 is a diagram showing a modified embodiment of the partially circular columnar backpack carrier type golf practice tool shown in FIG. 1. Shoulder straps and waist-belts are not shown. In this embodiment, an edging portion 25 is provided or arranged between the outer side surface 13 and the back touch portion 14 of the backpack type golf practice tool main body 11. By providing the edging portions 25 and 26 on both sides, it becomes difficult for the back, arms and head to hit the corners of the main body 11 of the backpack carrier type golf practice tool, and the golf players get easier to move. Even when the back touch portion 14 is wider than the back, if the edging portions are made so that the width of the back touch portion is substantially the same as or narrower than the width of the back, it is easy to carry the backpack carrier type golf practice tool on the back, and the golf player can easily move and play. Though the corners are easily damaged since the angle of the corner is small if the main body of the backpack carrier type golf practice tool does not have the edging portion as shown in FIG. 1, the damage of the corners can also be prevented by providing the edging portion 25. The edging portions 25 and 26 may be flat, curved, or appropriately deformed. The term "partial cylindrical shape" or "partial circular columnar shape" in the present invention includes such the edging portions and includes a shape similar to these. The upper surface and the lower surface of the main body may be a curved surface having a bulge or a slightly sunken curved surface in addition to the flat surface. The scope of the present invention also includes the case where a slightly uneven curved surface is formed on the side surface and a similar curved surface. Further, it also includes various other columnar shapes, and shapes similar to the shapes described in the present specification.

Figure 8:
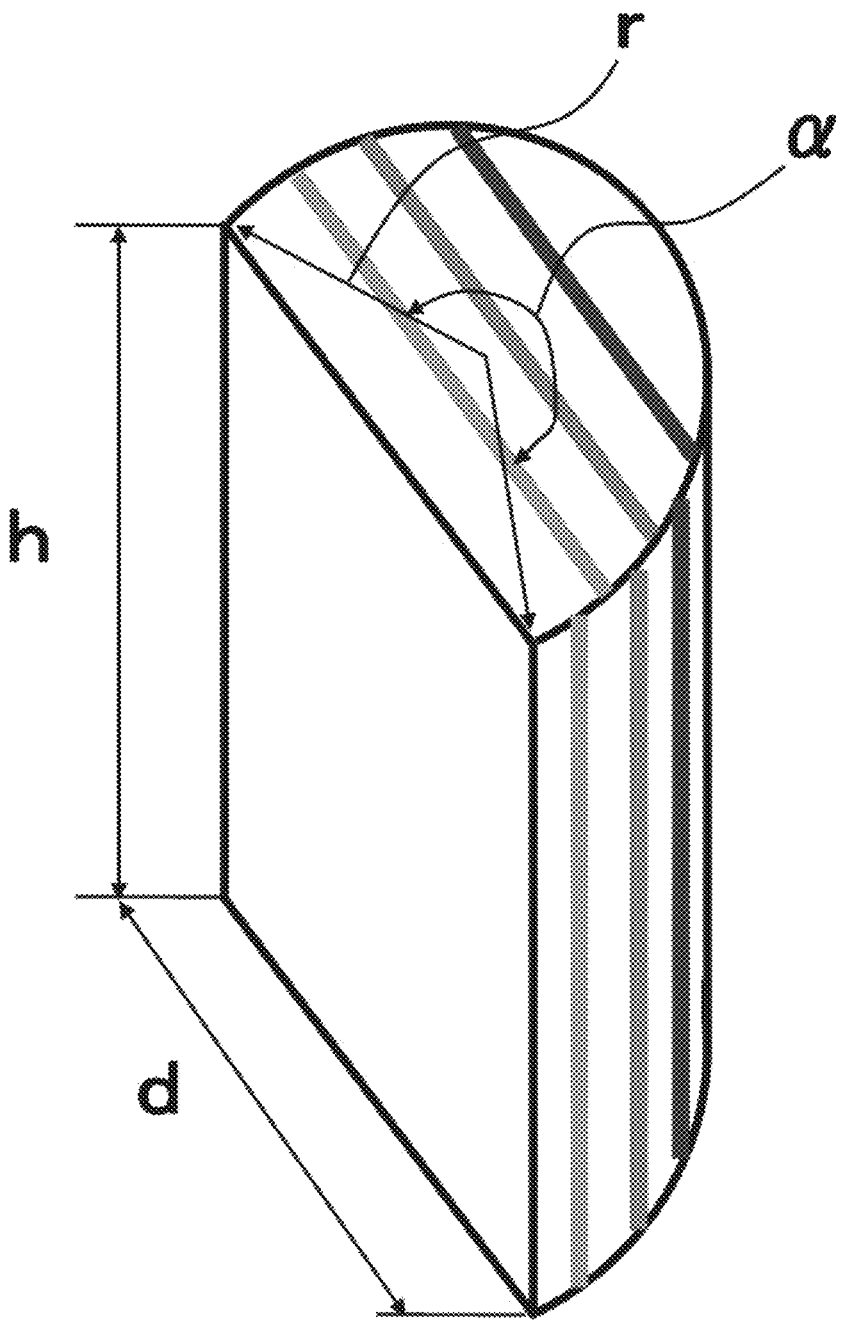
FIG. 8 is a diagram showing a partially (circular) cylindrical or circular columnar backpack carrier type golf practice tool.

Since it is a practice tool that humans carry on their backs, its size is almost obvious from the figures and specification so far. The approximate size of the backpack golf training tool of the present invention is estimated. FIG. 8 is a diagram showing a partially circular cylindrical or circular columnar backpack carrier type golf practice tool. It is the same figure as FIG. 1 and is the figure in which the dimensions are described. That is, FIG. 8 is the diagram showing the approximate size of the backpack type golf practice tool. (See FIG. 1 for reference numerals.) The radius r of the bottom surface 12 of the partial cylinder 11 is about 10 cm to 40 cm. The height h of the partial cylinder 11, which is the length of the back touch portion, is about 20 cm to 80 cm. The shape of the partial circle is determined by a central angle $\alpha$, which is about 120 to about 300 degrees. The width d of the back touch portion 11 is determined by r and $\alpha$, and it is about 15 cm to 80 cm. Of course, the above sizes can be smaller or larger than the values shown. Since the backpack carrier type golf practice tool of the present invention can be used by children or by large persons, the size may be appropriately determined according to each body size.

Figure 6:
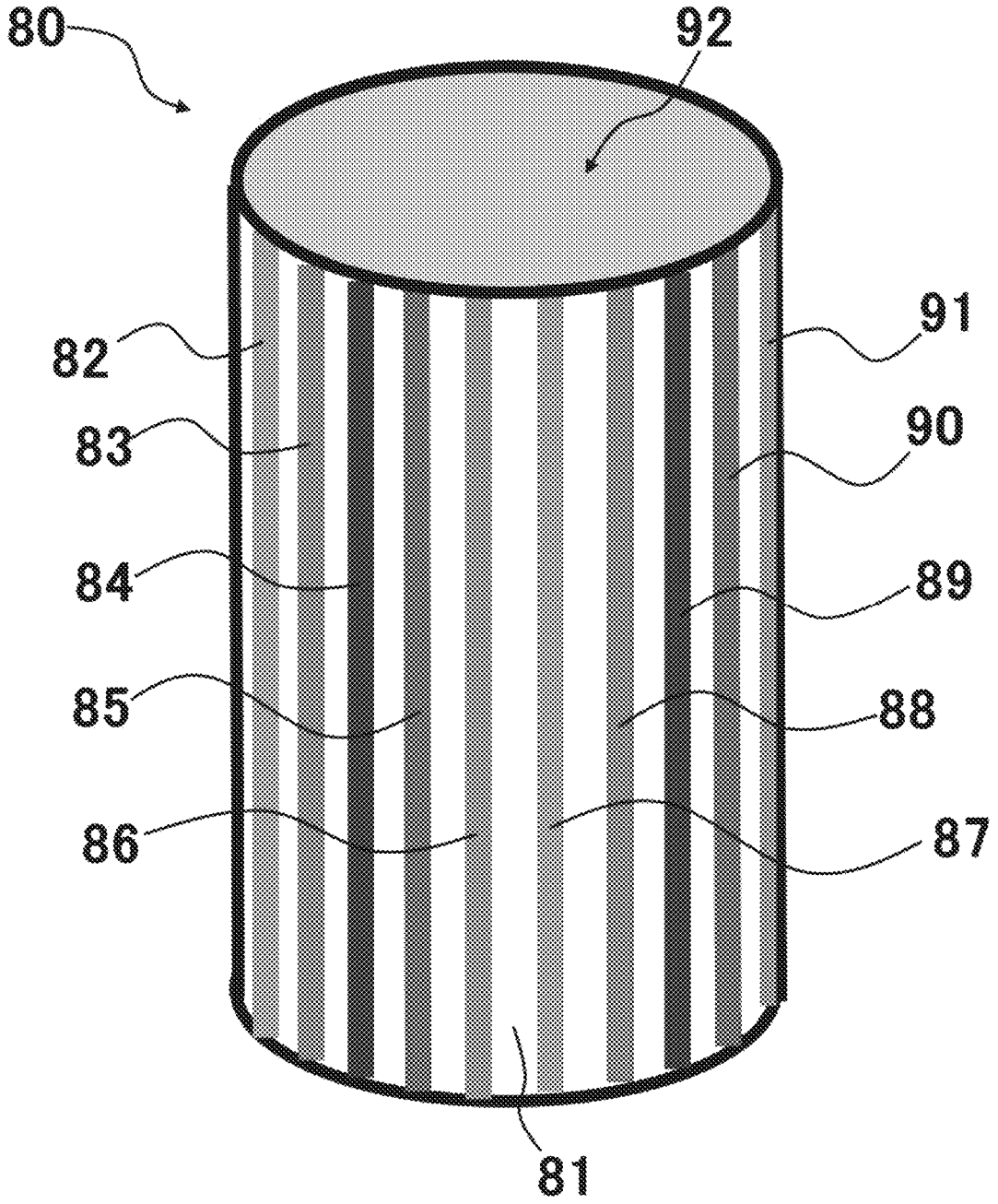
FIG. 6 is a diagram showing an arm supporter 80 for golf practice.

FIG. 6 is a diagram showing a second invention similar to the above-mentioned invention and showing an arm supporter 80 for golf practice, which may be also called an arm ring type golf practice tool or a golf practice arm supporter, that the golf prayer wraps around the arm. It is important for the golf player to make a good condition of the arm to control the direction and speed of the ball. The golf practice arm supporter has a flexible cylindrical shape. The arm of the golf player is passed through the tube hole 92 of the golf practice arm supporter and the approximately middle part of the golf practice arm supporter is placed on the elbow part of the arm of the golf player. Around the outer side surface of the golf practice arm supporter, vertical stripe patterns, which contain vertical striped lines, 82 to 91 similar to the above-mentioned columnar backpack carrier type golf practice tool are drawn in the arm length direction. The vertical striped patterns are also drawn on the opposite side, which are not visible in FIG. 6 because they are drawn around the outer side surface.

Figure 7:
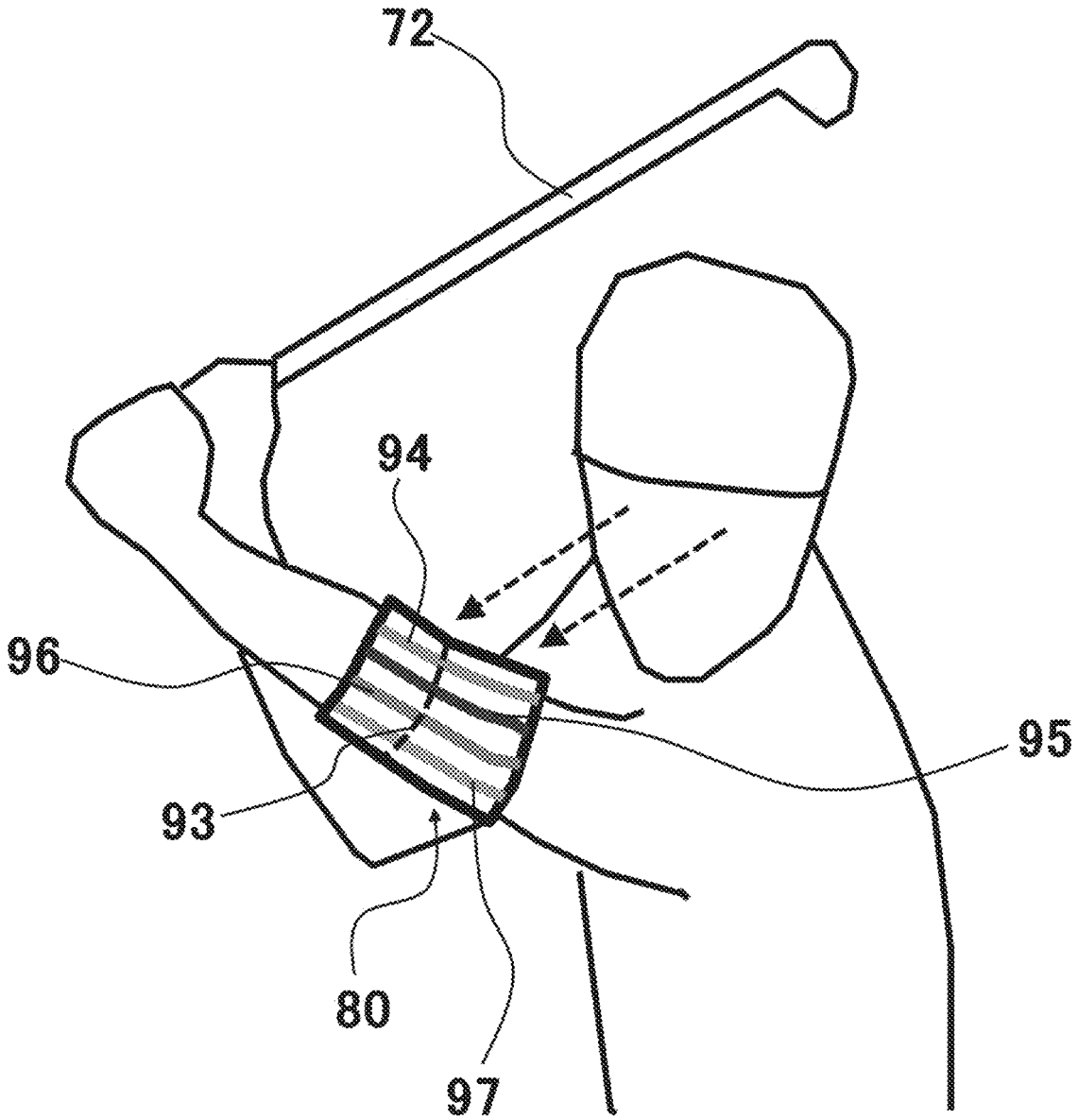
FIG. 7 is a diagram showing an example of how to use the golf practice arm supporter of the present invention.

FIG. 7 is a diagram showing an example of how to use the golf practice arm supporter of the present invention. The posture of the golf player shown in FIG. 7 is the posture at the time of backswing and is the posture in which the left arm is brought close toward the chest and the elbow of the left arm is extended. The left arm is passed through the golf practice arm supporter 80 and the middle portion thereof is applied to the elbow portion of the left arm, which is indicated by the broken line 93. The stripe (line) patterns 94 to 97 are drawn on the golf practice arm supporter 80. The number of the striped patterns is more because all of them are not seen. Since the left arm should be as straight as possible, the stripes should be as straight as possible. Since it can be visually confirmed as indicated by the broken line arrow in FIG. 7, the state of the left arm can be brought closer to the ideal state. When controlling the flying direction of the golf ball by twisting the left arm, since the striped (line) patterns can be color-coded, the left arm can be held when the striped pattern having a predetermined color comes at an appropriate position. Alternatively, the striped patterns may be numbered to match the numbered striped patterns. The arm supporter for golf practice of the present invention can also be used to determine how to bend the elbow. For example, the elbow portion passes through the golf practice arm supporter of the present invention, and it is also possible to set the angle at which the elbow is bent and the angle at which the elbow is twisted.

The material of the golf practice arm supporter of the present invention may be rubber, cloth, paper, or various elastic materials. The size of the inner ring may be large enough that the arm passes through the arm supporter, and the size of the inner ring may be larger than that around the arm if it can be fixed to the arm with rubber at both ends. If it is an elastic member such as rubber, the inner size of the ring may be smaller than that around the arm, and after the arm passed through the ring, the golf practice arm supporter fits the arm and is fixed to the arm so that the arm is tightened to some extent. Instead of the striped lines, band-shaped color patterns similar to those in FIG. 2, which may be considered to be a thickened striped line, may be used. It may be used in other parts of the arm, such as the wrist part. That is, the twisted state of the wrist can be grasped by using the golf practice arm supporter of the present invention. At this time, it can also be called a golf practice wrist supporter.

Recently, the number of elementary school students playing golf is increasing, and it is more effective to teach them golf visually than to teach them golf by theory. If they use vision, they can learn it quickly while being interested. The present invention is particularly useful as an educational tool for such children. The instructor can also check it directly with the eyes, and it is easy to educate beginners. Also, golf skills can be improved secretly since golf can be practiced alone if a mirror is used.

As explained in detail above, even a beginner can easily learn the basic posture of golf play if the beginner practices golf by wearing the backpack carrier type golf practice tool and the golf practice arm supporter. In addition, even children such as elementary school students can improve their golf level while having fun. Since the golf practice tool having the striped patterns of the present invention teaches the position and movement of the legs, arms, various bodies, etc. by the striped patterns, it can be also applied to various golf exercises other than the above-described embodiments and examples. If a content described and explained in a certain part of the specification can be explained without contradiction in other part of the specification, it goes without saying that the content can be applied to the other part of the specification. Also, it goes without saying that the contents of the examples and embodiments described in the present application document can be used in combination with the contents of other examples and embodiments. Furthermore, it goes without saying that the embodiment is an example and can be modified in various ways without departing from the scope of the present invention, and the scope of rights of the present invention is not limited to the embodiments.

INDUSTRIAL APPLICABILITY

The backpack carrier type golf practice tool and the golf practice arm supporter of the present invention can also be used as practice tools for baseball, tennis, and the like.

What is claimed is:

1. A golf practice tool comprising:
a columnar box having:
an upper surface that is substantially flat;
a bottom surface opposite the upper surface;
a rear surface extending from the upper surface to the bottom surface, the rear surface touching a back of a golf player while the columnar box is being carried on the back of the golf player; and
a side surface extending from the upper surface to the bottom surface and being connected to the rear surface;
a shoulder strap connected to the columnar box being adapted to enable the columnar box to be carried on the back of the golf player;
a striped pattern provided on at least one of:
the upper surface, the striped pattern being oriented substantially parallel to the rear surface; and
the side surface, the striped pattern being oriented substantially perpendicular to the bottom surface,
the striped pattern being the only pattern on the at least one of the upper surface and the side surface.

2. The golf practice tool according to claim 1, further comprising:
an edge surface between the rear surface and the side surface of the columnar box.

3. The golf practice tool according to claim 1,
an inclination of an upper body of the golf player being adjusted by using the striped pattern.

4. The golf practice tool according to claim 3,
a shape of the columnar box being a partial circular cylinder and the side surface being a substantially circular cylindrical side surface.

5. The golf practice tool according to claim 3,
a shape of the columnar box being a polygonal column,
the bottom surface being a substantially polygonal bottom surface, and
the rear surface being one surface of the polygonal column.

6. The golf practice tool according to claim 1,
the striped pattern being on the side surface, and
a rotation of an upper body of the golf player being adjusted by using the striped pattern.

7. The golf practice tool according to claim 1,
a main material of the columnar box being plastic.

8. The golf practice tool according to claim 7,
the plastic being a foamed plastic or a polyvinyl chloride.

9. The golf practice tool according to claim 1,
the columnar box being a balloon body formed by inflating with gas.

10. The golf practice tool according to claim 1,
a flexible member being arranged on the rear surface and adapted to touch the back of the golf player.

11. The golf practice tool according to claim 10,
the flexible member being an air mattress.

12. The golf practice tool according to claim 1,
the rear surface being a flexible member.

13. The golf practice tool according to claim 1,
the striped pattern being provided on both the upper surface and the side surface.

14. The golf practice tool according to claim 1,
the striped pattern being provided on an entirety of the at least one of the upper surface and the side surface.

15. The golf practice tool according to claim 1,
the striped pattern being provided on an entirety of both the upper surface and the side surface.

16. The golf practice tool according to claim 1,
the striped pattern being color coded.

17. A golf practice tool comprising:
an arm supporter which is adapted for an arm of a golf player to pass through; and
a striped pattern drawn on the arm supporter, the striped pattern being oriented substantially parallel to a longitudinal direction of the arm of the golf player,
the stripe pattern being color-coded or numbered.

18. The golf practice tool according to claim 17,
a state of the arm of the golf player during a golf swing being adjusted by using the stripe pattern.

* * * * *